United States Patent [19]

Schenk

[11] Patent Number: 4,806,082

[45] Date of Patent: Feb. 21, 1989

[54] FLUID ACTUATED PUMP WITH IMPROVED FLOW-LIMITING FLUID REFILL VALVE

[75] Inventor: Jacob W. Schenk, North Haledon, N.J.

[73] Assignee: Pennwalt Corporation, Philadelphia, Pa.

[21] Appl. No.: 118,500

[22] Filed: Nov. 9, 1987

[51] Int. Cl.[4] ..... F04B 43/10

[52] U.S. Cl. ..... 417/388; 137/512.3; 137/517; 137/526; 137/565; 137/909; 251/57

[58] Field of Search ..... 417/9, 388; 137/909, 137/512.3, 513, 517, 526, 538, 565; 251/57

[56] References Cited

U.S. PATENT DOCUMENTS

| | | | |
|---|---|---|---|
| 1,170,050 | 2/1916 | Daniels | 137/513 |
| 1,258,167 | 3/1918 | Vollman . | |
| 1,876,735 | 6/1928 | Noble . | |
| 2,404,924 | 1/1943 | Sacchini . | |
| 2,502,525 | 4/1950 | Krugler . | |
| 3,433,161 | 3/1969 | Vetter | 417/388 |
| 3,993,361 | 11/1976 | Stelzer . | |
| 4,174,731 | 11/1979 | Sturgis et al. . | |
| 4,257,452 | 3/1981 | Hill et al. | 137/517 X |
| 4,353,684 | 10/1982 | Christman . | |
| 4,392,784 | 7/1983 | Hanafi . | |
| 4,474,540 | 10/1984 | Bonastia et al. | 417/388 X |
| 4,564,340 | 1/1986 | Stahlkopf . | |
| 4,590,962 | 5/1986 | Tespa | 137/512.3 X |

OTHER PUBLICATIONS

Brochure of Pennwalt Corporation (Wallace & Tiernan Div.), "Tubular Diaphragm Metering Pumps, " Cat. File 430.200, Rev. 6-86.

*Primary Examiner*—Stephen Hepperle

*Attorney, Agent, or Firm*—Panitch, Schwarze, Jacobs & Nadel

[57] ABSTRACT

An improved flow-limiting fluid refill valve for use with a fluid-actuated pump having a fluid chamber comprises a valve housing, fluid inlet means in communication with a source of hydraulic fluid and fluid outlet means in fluid communication with the fluid chamber of the pump. A first valve within the valve housing is provided between the fluid inlet means and the fluid outlet means for permitting a flow of fluid from the fluid source to the fluid chamber when the suction pressure within the fluid chamber exceeds the first predetermined pressure limit indicating that the fluid within the fluid chamber has been depleted below a predetermined fluid limit. The improvement comprises a second valve within the valve housing for preventing the flow of fluid from the fluid source to the fluid chamber when the suction pressure within the fluid chamber exceeds a second predetermined pressure limit greater than the first predetermined pressure limit and indicating abnormal operation of the pump.

3 Claims, 2 Drawing Sheets

FLUID ACTUATED PUMP WITH IMPROVED FLOW-LIMITING FLUID REFILL VALVE

BACKGROUND OF THE INVENTION

The present invention relates generally to fluid refill valves for fluid-actuated pumps and, more particularly, to such a fluid refill valve which is fluid flow limiting.

There are many varieties of commercially available fluid-actuated pumping systems. In many such pumping systems, it is necessary to maintain the amount of actuating fluid in a fluid chamber portion of the pumping system within predetermined fluid limits for proper operation of the pumping system. Accordingly, many such pumping systems include a fluid refill valve in communication with both the fluid chamber and a source of activating or operating fluid. When the fluid within the fluid chamber falls below a predetermined level necessary for proper operation of the pumping system, the fluid refill valve is opened during at least a portion of the pumping cycle to permit replacement or make-up fluid to flow from the fluid source, through the fluid refill valve and into the fluid chamber. The fluid refill valve continues to open during the corresponding portion of subsequent pumping cycles until the level of fluid within the fluid chamber has increased above the predetermined level to provide sufficient fluid for proper operation of the pumping system.

Fluid refill valves of the type described above are generally opened based upon the suction pressure in the fluid chamber of the pump during the suction portion of the pumping cycle. When the fluid within the fluid chamber falls below the predetermined level, further operation of the pump results in the creation of an increased suction pressure (becoming more negative with respect to atmospheric pressure) within the fluid chamber during the suction portion of the cycle. The increased suction pressure causes the fluid refill valve to open to permit the flow of small amounts of make-up fluid to the fluid chamber with each suction stroke of the pump. As the make-up fluid is added to the fluid chamber, the suction pressure within the fluid chamber diminishes and, eventually, the suction pressure decreases below the pressure necessary to open the refill valve and the valve remains closed, preventing the further flow of make-up fluid to the fluid chamber.

While fluid refill valves of the type described above are generally effective in maintaining the proper level of fluid within the fluid chamber during normal pumping system operation, during certain abnormal pumping system conditions, fluid refill valves of this type can cause the fluid chamber to become overfilled, possibly resulting in a deterioration and/or failure of one or more components of the pumping system. For example, if the suction pressure within the valve chamber is increased due to a non-fluid level reason, such as a mistakenly closed suction line valve, a restriction in a suction line or any other similar abnormality, the suction pressure within the fluid chamber will increase, causing the fluid refill valve to be in the open position each time the pump is in the pertinent portion of the pumping cycle, permitting excessive amounts of make-up fluid to flow into the fluid chamber, whether or not such make-up fluid is needed. Since under such circumstances the filling of the fluid chamber does not decrease the suction pressure in the fluid chamber, the refill valve will remain in the open condition during the corresponding portion of each pumping cycle. Eventually, the fluid chamber will become overfilled, preventing the proper operation of the pump and possibly causing a deterioration or serious malfunction within the pumping system.

The present invention overcomes the potential overfill problems associated with such a fluid refill valve by providing means for limiting the flow of fluid through the oil refill valve, particularly when the fluid refill valve is opened due to an abnormally high suction pressure within the fluid chamber.

SUMMARY OF THE INVENTION

Briefly stated, the present invention comprises an improved, flow-limiting fluid refill valve for a fluid-actuated pump having a fluid chamber containing fluid. The valve is comprised of a valve housing, fluid inlet means in fluid communication with a source of hydraulic fluid and fluid outlet means in fluid communication with the chamber of the pump. First valve means are provided within the valve housing between the fluid inlet means and the fluid outlet means for permitting a flow of fluid from the fluid source to the fluid chamber when suction pressure within the fluid chamber exceeds a first predetermined pressure limit, indicating that the fluid within the fluid chamber has been depleted below a predetermined fluid limit. The improvement comprises second valve means within the valve housing for preventing the flow of fluid from the fluid source to the fluid chamber when the suction pressure within the fluid chamber exceeds a second predetermined pressure limit greater than the first predetermined pressure limit indicating abnormal operation of the pump.

BRIEF DESCRIPTION OF THE DRAWINGS

The foregoing summary, as well as the following detailed description, will be better understood when read in conjunction with the appended drawings. For the purpose of illustrating the present invention, there is shown in the drawings an embodiment which is presently preferred, it being understood, however, that this invention is not limited to the precise arrangement and instrumentalities shown. In the drawings.

DESCRIPTION OF PREFERRED EMBODIMENT

Figure 1:
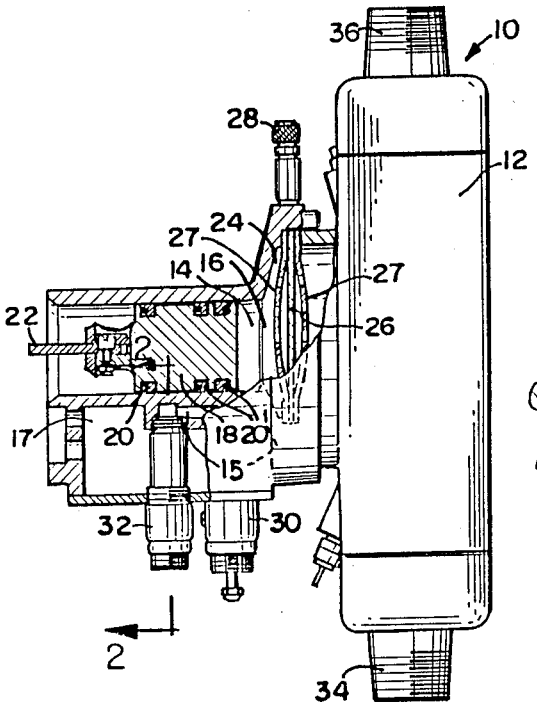
FIG. 1 is a side elevational view, partially broken away, of a fluid-actuated pump including a flow-limiting fluid refill valve in accordance with the present invention.

Referring to the drawings, wherein like numerals indicate like elements throughout, there is shown in FIG. 1 a pump system or pump 10 to illustrate the operation of the present invention. The pump 10 shown in FIG. 1 is a tubular diaphragm metering pump of a type generally well known and commercially available from the Wallace & Tiernan Division of Pennwalt Corporation. A complete description of the structure and operation of the pump 10 is available from the manufacturer and is not necessary for a complete understanding of the present invention. Suffice it to say that the pump 10 which is fluid-actuated, preferably by hydraulic fluid, includes a housing 12 within which is contained a generally cylindrical fluid chamber 14 and a supply of fluid, in the embodiment shown, hydraulic fluid 16. A generally cylindrical piston 18 having generally annular piston seals 20 of a type well known in the art is disposed within the fluid chamber 14 for reciprocal movement in a manner well known in the art. A piston rod 22 extends from the rod side of the piston 18 and may be secured to a suitable reciprocating driving means (not shown) in a manner well known in the art. The end of the fluid chamber 14 on the head side of the piston 18 is in fluid communication with a larger sized generally cylindrical diaphragm chamber 24. A disc diaphragm 26 and corresponding baffle plates 27 are positioned within the diaphragm chamber 24 in a manner well known in the art. The pump 10 further includes an air purge valve 28, a pressure relief valve 30, and a flow-limiting fluid refill valve 32 in accordance with the present invention.

In operation of the pump 10, forward (rightward when viewing FIG. 1) movement of the piston 18 (the discharge stroke) displaces a portion of the hydraulic fluid 16 within the fluid chamber 14 and the diaphragm chamber 24 causing the disc diaphragm 26 to flex outwardly (toward the right when viewing FIG. 1). The outward flexing of the disc diaphragm 26 causes compression of a tubular diaphragm (not shown) resulting in the discharge of fluid being pumped or process fluid (not shown) from the pump outlet opening 36. The rearward (leftward when viewing FIG. 1) movement of the piston 18 (the suction stroke) draws the hydraulic fluid 16 within the fluid chamber 14 and the diaphragm chamber 24 rearwardly, resulting in the disc diaphragm 26 moving inwardly (towards the left when viewing FIG. 1). The inward movement of the disc diaphragm 26 causes the tubular diaphragm (not shown) to draw process fluid into the pump through the pump inlet opening 34.

The air purge valve 28 functions in a manner well known in the art to remove air which has become entrained within the hydraulic fluid system. The pressure relief valve 30 also functions in a manner well known in the art to relieve excessive pressure buildup within the fluid chamber 14.

During the forward movement of the piston 18, small amounts of hydraulic fluid are forced out of the fluid chamber 14 through the air purge valve 28. In addition, small amounts of hydraulic fluid may be removed from the fluid chamber 14 as a result of leakage around the piston seals 20. The continued loss of small amounts of hydraulic fluid from within the fluid chamber 14 during normal operation of the pump 10 eventually reduces the level of the fluid and causes the disc diaphragm 26 to be drawn further and further inwardly during rearward movement of the piston 18. Eventually, with enough fluid loss, the disc diaphragm 26 begins to engage the rear baffle plate 27 before the piston 18 reaches its rearmost travel. Such action results in the creation of an increased vacuum or suction pressure within the hydraulic system on each rearward stroke of the piston 18.

When the suction pressure or vacuum within the hydraulic system exceeds a first predetermined pressure limit, the fluid refill valve 32 is opened upon each rearward stroke of the piston 18 to provide replenishing or make-up hydraulic fluid to refill the fluid chamber 14 in a manner which will hereinafter become apparent. When the hydraulic fluid 16 within the fluid chamber 14 has been replenished and the suction pressure falls below the first predetermined pressure limit, the refill valve 32 remains closed and the pump 10 continues to function in the normal manner.

Figure 2:
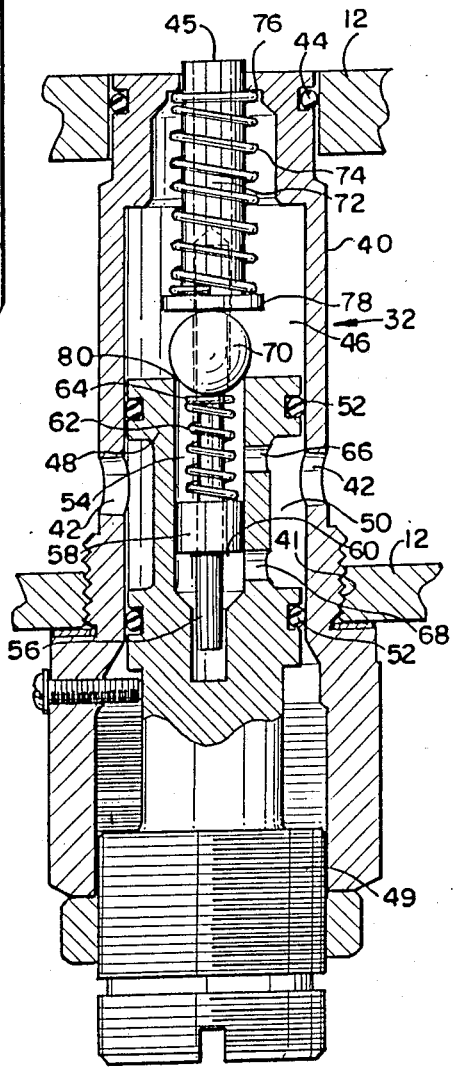
FIG. 2 is an enlarged sectional view of the flow-limiting fluid refill valve taken along line 2—2 of FIG. 1, with the first valve means in a closed condition and the second valve means in an open condition.

In FIG. 2 there is shown an enlarged sectional view of the fluid refill valve 32. The fluid refill valve 32 is comprised of a valve housing or body 40 which, in the presently preferred embodiment, is generally cylindrical in shape. The valve housing 40 includes hydraulic fluid inlet means, in the present embodiment suitably sized, generally circular inlet openings 42 which are in fluid communication with a source of hydraulic fluid, in the present embodiment a hydraulic reservoir 17 within the pump housing 12. While, in the presently preferred embodiment, the fluid refill valve 32 is described as being employed in connection with hydraulic fluid, it will be appreciated by those skilled in the art that other types of fluid may alternatively be employed.

The valve housing 40 is installed within suitably sized, generally circular, aligned openings in the pump housing 12 as shown in both FIGS. 1 and 2. Preferably, the valve body 40 is retained in place by threads 41 which engage complementary threads within the opening in the pump housing 12. A sealing means, in the present embodiment an O ring seal 44, is provided for sealing the opening in the pump housing 12. The refill valve 32 also includes a fluid outlet means or outlet port 45 on its inner end in fluid communication with the fluid chamber 14 through a fluid conduit 15 within the valve housing 12.

The valve body 40 includes an axially extending, generally cylindrical inner bore or chamber 46. A generally cylindrical valve support member 48 is installed within the inner chamber 46 and is held in place by a threaded retaining portion 49 which is threaded into valve body 40 (lower end when viewing FIG. 2). The valve support member 48 is generally I-shaped in its upper portion, in cross section as shown in FIG. 2, and, with the valve body 40, forms a generally annular subchamber 50. The annular subchamber 50 is in fluid communication with the fluid inlet openings 42 and serves as a generally annular fluid supply chamber 50. Sealing means, in the present embodiment a pair of generally annular O rings 52 are installed on both axial ends of the annular chamber 50 to prevent leakage of hydraulic fluid from the annular fluid supply chamber 50 into the remainder of the generally cylindrical inner chamber 46.

The valve support member 48 includes a generally axially extending central subchamber or spool chamber 54. Extending generally axially within subchamber 54 is an elongated, generally cylindrical first guide member 56. The purpose of the first guide member 56 is to guide the axial movement of a generally cylindrical coaxial spool member 58. The spool member 58 includes a generally axially extending central opening (not shown) slightly larger in diameter than the outer diameter of the first guide member 56. The spool member 58 surrounds a portion of the first guide member 56 and moves axially with respect to the first guide member 56 under certain conditions which will hereinafter be described. A spool stop member, in the present embodiment a generally annular flange 60 having an outer diameter greater than the diameter of the spool member opening is employed to limit movement of the spool member 58 along the first guide member 56 in a first or outward direction (downwardly when viewing FIG. 2). A biasing means, in the present embodiment a coil spring member 62, surrounds the first guide member 56 on the side of the spool member 58 opposite the annular flange 60. A spring stop member, in the present embodiment a generally annular flange member 64 is positioned on the first guide member 56 at a predetermined axial location. The coil spring member 62 engages flange member 64 with a predetermined compression which causes the coil spring member 62 to bias the spool member 58 into engagement with annular flange 60. During normal operation of the pump 10 the biasing force of coil spring member 62 is sufficient to maintain the spool member 58 against the annular flange 60, as shown in FIG. 2. A pair of generally cylindrical fluid conduits 66 and 68 extend through the valve support member 48 to provide fluid communication between the annular fluid supply chamber 50 and the central subchamber 54.

A ball check 70 of the type generally well known in the art is located on the first guide member 56 on the side of the annular flange 64 opposite from the coil spring member 62. The distal end of the first guide member 56 beyond the ball check 70 extends into a generally tubular second guide member 72. The second guide member 72 and the ball check 70 are retained on guide member 56. The second guide member 72 is movably supported within a suitably sized, generally circular opening extending through the top end of the valve body 40 (when viewing FIG. 2). A biasing means, in the present embodiment a coil spring member 74, surrounds a portion of the second guide member 72. One end of the coil spring member 74 engages an annular shoulder 76 within the valve housing 40. The other end of the coil spring member 74 engages an annular flange member 78 on the outer end of the second guide member 72 proximate the ball check 70. In this manner, the coil spring member 74 serves as a biasing means to urge the ball check 70 into engagement with an annular ball check seat 80 surrounding the end of central subchamber 54 of valve support member 48.

FIG. 2 shows the refill valve 32 in a closed condition in which no fluid is permitted to flow from the fluid inlet openings 42 to the fluid outlet port 45. During the discharge stroke of the piston 18, the pressure buildup in the fluid chamber 14 in combination with the biasing force of coil spring member 74 forces the ball check 70 into engagement with the ball check seat 80 to block the fluid flow path out of the central subchamber 54 and to thereby prevent fluid from flowing through the refill valve 32. During the suction stroke of the piston 18 only the biasing force of coil spring member 74 urges the ball check 70 into engagement with the ball check seat 80 blocking off the fluid flow path through the refill valve 32. As discussed above, the refill valve 32 remains in the closed condition as long as the suction pressure within the fluid chamber 14 during the suction stroke of the piston 18 remains below a first predetermined pressure limit. In the present embodiment, the first predetermined pressure limit is established by the compression of coil spring member 74 to be the amount of suction pressure present in the fluid chamber 14 when the hydraulic fluid 16 has been depleted to a level in which the disc diaphragm 26 just begins to engage the baffle plate 27 at the completion of the rearward stroke of the piston 18. The compression of the coil spring member 74 is adjustable by adjusting the position of the threaded retaining portion 49 to valve support member 48 to correspondingly adjust the first predetermined pressure limit. The coil spring member 74 serves as a first biasing means to bias the ball check 70 to block the flow of fluid through the refill valve 32, as previously described. In this manner, the ball check 70, ball check seat 80 and related components combine to form a first valve means.

Figure 3:
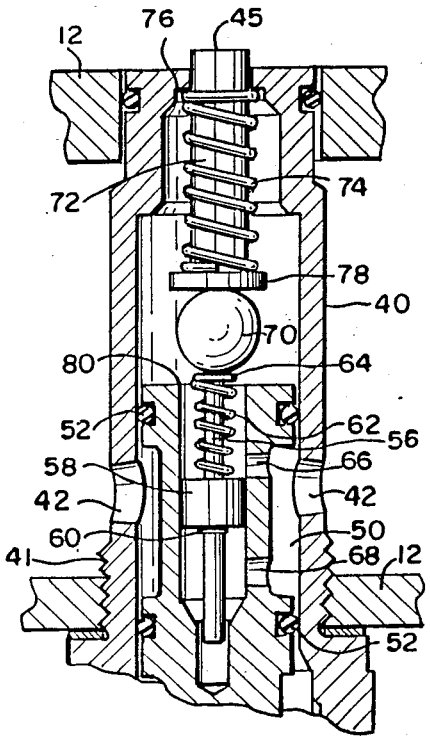
FIG. 3 is a view of a portion of FIG. 2 showing the first valve means in an open condition and the second valve means in an open condition.

When the fluid 16 within the fluid chamber 14 is depleted below the first predetermined minimum fluid level, a suction pressure which exceeds the first predetermined pressure limit is created within the fluid chamber 14 during the suction stroke of the piston 18. Such a suction pressure is sufficient to overcome the bias of coil spring member 74 resulting in the upward (FIGS. 2, 3 and 4) movement of the first and second guide members 56 and 72 and a corresponding movement of the ball check 70 away from the ball check seat 80, as shown in FIG. 3. As is well known in the art, movement of the ball check 70 away from the ball check seat 80 results in the opening of the first valve means to permit fluid to flow from the fluid source or fluid inlet ports 42 through the valve 32 and into the fluid chamber 14 by virtue of the suction pressure created within the fluid chamber 14.

Only a small amount of fluid is drawn into the fluid chamber 14 with each suction stroke of the piston 18. As previously indicated, when the fluid within the fluid chamber again exceeds the predetermined fluid level, the suction pressure in the fluid chamber is insufficient to overcome the bias of coiled spring member 74 and the ball check 70 remains in place on the ball check seat 80, as shown in FIG. 2, preventing the flow of fluid through the refill valve 32.

Figure 4:
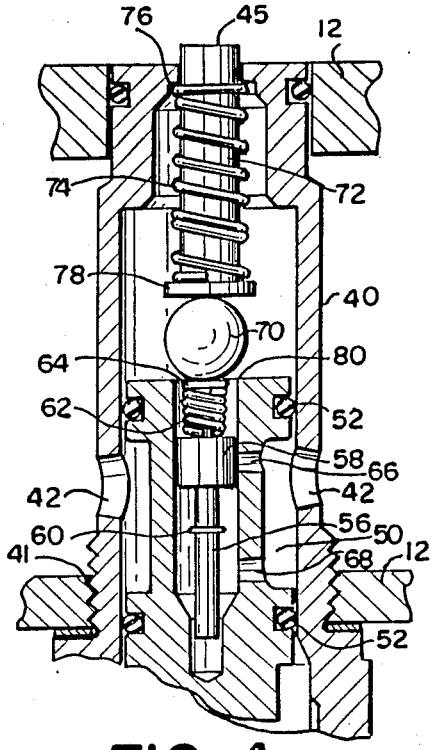
FIG. 4 is a view of a portion of FIG. 2 showing the first valve means in an open condition and the second valve means in a closed position under high suction pressure.

As previously indicated, when certain abnormal conditions occur within the pump, an abnormally high suction pressure is created within the fluid chamber 14 when the piston 18 strokes rearwardly. The ball check 70 is moved away from the ball check seat 80 to permit the flow of makeup fluid into the fluid chamber 16, as described above. When such a suction pressure is created within the fluid chamber 14, which is in excess of a second predetermined pressure limit greater than the first predetermined pressure limit, an amount of fluid greater than normal is drawn through the refill valve 32. The high fluid flow through the inlet ports 42 causes a pressure differential across the spool member 58 through conduits 66 and 68. The pressure differential is sufficient to move the spool member 58 away from annular flange 60 to the position as shown in FIG. 4. The second predetermined pressure limit is established as being the pressure sufficient to overcome the bias of coil spring member 62, permitting compression of the spring member 62 and the upward (FIG. 4) movement of the spool member 58. When the spool member 58 reaches the position as shown in FIG. 4, the spool member functions as a second valve means for blocking fluid conduit 66, thereby preventing the flow of fluid from the fluid source or fluid inlet port 42 through the valve 32 and into the fluid chamber 14, and effectively disabling the fluid refill system. In this manner, the fluid refill valve 32 operates to prevent overfilling of the fluid chamber 14, thereby preventing damage to the pump 10 or the various pump components which may result from excessive hydraulic fluid within the fluid chamber 14. The pressure within the hydraulic system will cause the hydraulic fluid to cavitate, disabling the hydraulic system and disabling the pump 10. When the reason for the high suction pressure within the fluid chamber 14 has been identified and corrected so that the suction pressure within the fluid chamber is below the second predetermined pressure limit, spring member 62 again biases spool member 58 into engagement with annular flange 60 to permit the flow of make-up fluid through the valve 32, as described above.

From the foregoing description, it can be seen that the present invention comprises a fluid refill valve for a pumping system which includes means for limiting the flow of fluid during abnormal pumping conditions. It will be recognized by those skilled in the art that changes may be made to the above-identified embodiment of the invention without departing from the broad inventive concepts thereof. It is understood, therefore, that this invention is not limited to the particular embodiment disclosed, but it is intended to cover all modifications which are within the scope and spirit of the invention as defined by the appended claims.

I claim:

1. In a fluid-actuated pump having a fluid chamber, an improved flow-limiting fluid refill valve comprising:

a valve housing;

fluid inlet means in fluid communication with a source of hydraulic fluid;

fluid outlet means in fluid communication with the fluid chamber of the pump; and first valve means within the valve housing between the fluid inlet means and the fluid outlet means for permitting a flow of fluid from the fluid source to the fluid chamber when suction pressure within the fluid chamber exceeds a first predetermined pressure limit indicating that the fluid within the fluid chamber has been depleted below a predetermined fluid limit, wherein the improvement comprises second valve means within the valve housing for preventing the flow of fluid from the fluid source to the fluid chamber when the suction pressure within the fluid chamber exceeds a second predetermined pressure limit greater than the first predetermined pressure limit indicating abnormal operation of the pump, the second valve means including;

a spool chamber between the fluid inlet means and the fluid outlet means and in fluid communication with the fluid outlet means;

at least one fluid conduit extending between the spool chamber and the fluid inlet means;

a spool member movable within the spool chamber; and biasing means engaging the spool member for biasing the spool member away from the fluid conduit when the pressure within the fluid chamber is less than or equal to the second predetermined pressure limit to permit the flow of fluid into the spool chamber, the biasing means being overcome so that the spool member moves to block the flow of fluid into the spool chamber when the suction pressure within the fluid chamber exceeds the second predetermined limit.

2. The flow-limiting fluid refill valve as recited in claim 1 wherein the spool chamber is generally cylindrical and the spool member is generally cylindrical with an outside diameter generally corresponding to the inside diameter of the spool chamber and wherein the biasing means is comprised of a coil spring, further including an elongated guide member extending coaxially with at least a portion of the spool chamber, the spool member including an axially extending opening having a diameter generally corresponding to the outer diameter of the guide member, the spool member surrounding the guide member and moving axially along the guide member.

3. The flow-limiting fluid refill valve as recited in claim 2 wherein the guide member includes a spool stop member and a spring stop member at spaced axial locations, the coil spring member surrounding the guide member with one end thereof engaging the spring stop member and the other end engaging one axial end of the spool member, the spring member biasing the spool member so that the other axial end of the spool member engages the spool stop member when the pressure within the fluid chamber does not exceed the second predetermined pressure limit.

* * * * *